United States Patent [19]

Morishita

[11] Patent Number: 4,979,474

[45] Date of Patent: Dec. 25, 1990

[54] CAMSHAFT ARRANGEMENT FOR MULTI VALVE ENGINE

[75] Inventor: Isao Morishita, Iwata, Japan

[73] Assignee: Yamaha Hatsudoki Kabushiki Haisha, Iwata, Japan

[21] Appl. No.: 357,477

[22] Filed: May 26, 1989

[30] Foreign Application Priority Data

May 30, 1988 [JP] Japan ..... 63-134056

[51] Int. Cl.[5] ..... F01L 1/04

[52] U.S. Cl. ..... 123/20.27

[58] Field of Search ..... 123/90.27, 90.39, 90.4, 123/90.44, 90.6, 188 R, 188 A, 193 H

[56] References Cited

U.S. PATENT DOCUMENTS

| | | | |
|---|---|---|---|
| 4,267,811 | 5/1981 | Springer | 123/90.27 |
| 4,335,686 | 6/1982 | Herdin et al. | 123/90.27 |
| 4,505,236 | 3/1985 | Nakamura | 123/90.27 |
| 4,519,364 | 5/1985 | Enomoto et al. | 123/90.27 |
| 4,553,515 | 11/1985 | King et al. | 123/90.27 |
| 4,556,025 | 12/1985 | Morita | 123/90.27 |
| 4,576,128 | 3/1986 | Kenichi | 123/90.27 |
| 4,632,073 | 12/1986 | Futakuchi | 123/90.27 |
| 4,662,323 | 5/1987 | Moriya | 123/90.27 |
| 4,671,222 | 6/1987 | Gallot et al. | 123/90.27 |
| 4,741,302 | 5/1988 | Oda et al. | 123/90.27 |

*Primary Examiner*—Charles J. Myhre
*Assistant Examiner*—Weilun Lo
*Attorney, Agent, or Firm*—Ernest A. Beutler

[57] ABSTRACT

Several embodiments of internal combustion engines having plural valves operated by a single overhead mounted camshaft. In each embodiment, there is provided a central cam lobe on the camshaft and adjacent bearing portions on opposite sides of this cam lobe for journaling the camshaft. In some embodiments, all intake valves are operated by a single rocker arm and in other embodiments two rocker arms are provided for operating a pair of the intake valves and a single of the intake valves.

7 Claims, 5 Drawing Sheets

CAMSHAFT ARRANGEMENT FOR MULTI VALVE ENGINE

BACKGROUND OF THE INVENTION

This invention relates to a camshaft arrangement for a multi-valve engine and more particularly to an improved, compact valve operating system for a multiple valve internal combustion engine operated by a single overhead mounted camshaft.

The advantages of multiple valve internal combustion engines are well known. Briefly, stated, the use of multiple valves for supplying either or both intake charge to the combustion chamber and for discharging the exhaust charge from the combustion chamber permits a greater effective flow area with lower reciprocating masses. Although the use of multiple valves and their advantages are well known, there have been a number of factors which have prevented the wider adoption of such multiple valve arrangements to internal combustion engines. One of the obstacles to the adoption of multiple valve engines has been the complexity of the arrangement for operating such multiple valves. Normally, it has been the practice to employ at least two camshafts for each cylinder or cylinder bank in order to operate the multiple valves. The addition of such a number of camshafts, obviously, gives rise to increased engine cost and also complexity.

Although some of these disadvantages can be overcome through the use of a single camshaft operating all of the valves, it has been difficult to provide a single camshaft arrangement for operating such multiple valves. When a single camshaft is employed for operating multiple valves, the camshaft has generally a greater number of lobes than are required when the intake valves and exhaust valves are each operated by a single camshaft. In addition, it is desirable to maintain the engine as compact as possible, and at times this has not been possible with the use of a single camshaft, although it would on the surface appear to be possible to do so. The reason for the complexity is the number of rocker arms that are required to operate all of the valves and, furthermore, the necessity to provide adequate support for the camshaft.

When a single camshaft is employed for operating multiple valves, the loading on the camshaft becomes quite high. Therefore, it is necessary to provide adequate bearing support for the camshaft so as to avoid its flexure. However, previous proposed arrangements for this purpose have not been completely satisfactory.

It is, therefore, a principal object of this invention to provide an improved valve operating mechanism for a multiple valve internal combustion engine.

It is another object of this invention to provide an improved arrangement for operating multiple valves of an internal combustion engine from a single camshaft.

It is a further object of this invention to provide a camshaft arrangement for operating multiple valves of a single cylinder or cylinder bank and wherein the camshaft is provided with adequate and well placed bearing support.

SUMMARY OF THE INVENTION

This invention is adapted to be embodied in a camshaft arrangement for a multiple valve internal combustion engine that is comprised of a cylinder head adapted to form in part a combustion chamber. A camshaft is journaled for rotation relative to the cylinder head about a camshaft axis. A first plurality of valves are supported for reciprocation about axes that lie on one side of the camshaft axis. A second plurality of valves are supported for reciprocation about axes that lie on the other side of the camshaft axis. Valve actuating means operate all of the valves from the camshaft. The valve actuating means includes at least one cam lobe formed on the camshaft and pivotally supported rocker arm means having a follower portion engaged with the one cam lobe for pivoting the rocker arm means. In accordance with the invention, bearing means are provided for journaling the camshaft for rotation about its axis that are disposed on opposite sides and adjacent the one cam lobe.

DETAILED DESCRIPTION OF THE PREFERRED EMBODIMENTS

Figure 1:
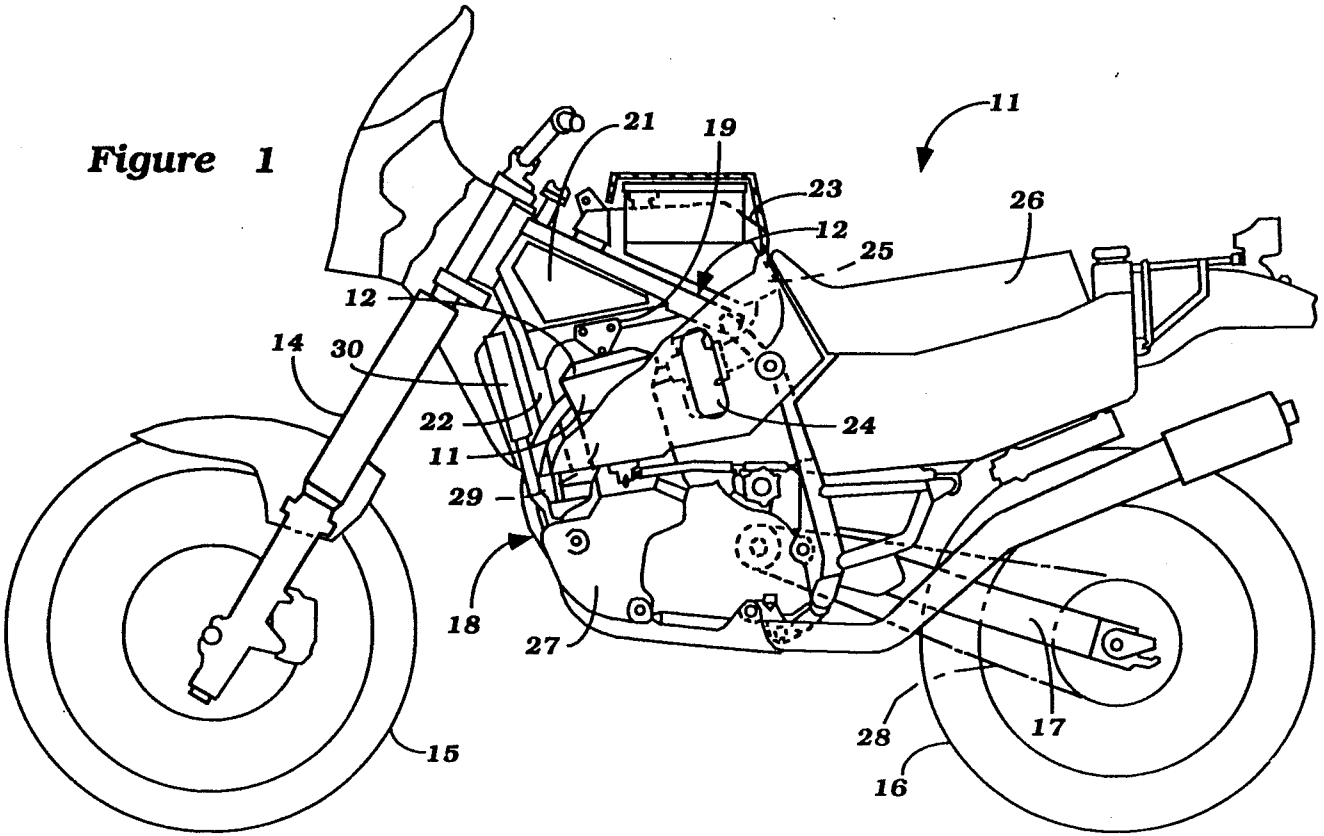
FIG. 1 is a side elevational view of a motorcycle powered by an internal combustion engine constructed in accordance with an embodiment of the invention, with portions broken away.

Referring first to FIG. 1, a motorcycle powered by an internal combustion engine constructed in accordance with an embodiment of the invention is identified generally by the reference numeral 11. The motorcycle 11 is depicted as a typical environment in which an engine embodying the invention may be employed. The invention has particular utility in conjunction with internal combustion engines used to power vehicles. However, it will be readily apparent to those skilled in the art that the invention may be practiced in conjunction with other engine applications.

The motorcycle 11 is comprised of a frame assembly, indicated generally by the refernce numeral 12, and which is of the welded up type including a head pipe 13 that journals a front fork assembly 14 for steering movement and which supports a front wheel 15 in a known manner. In a similar manner, a rear wheel 16 is supported by the frame assembly 12 by means including a trailing arm suspension 17.

Figure 2:
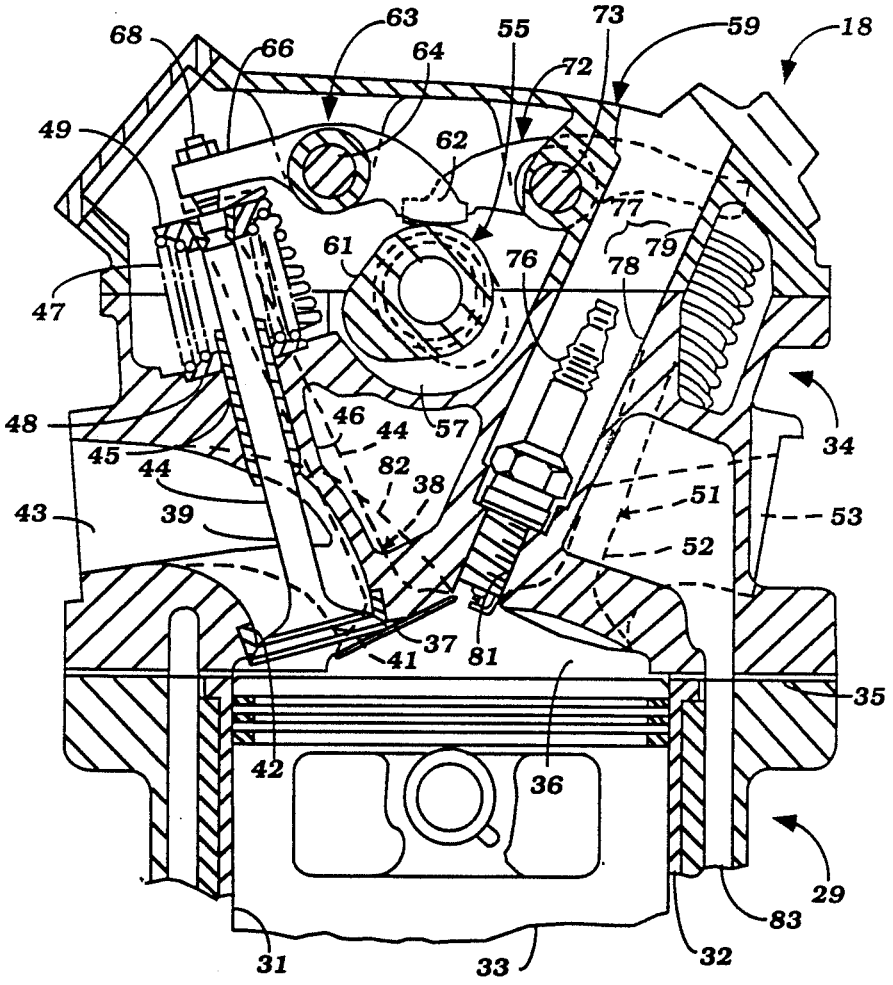
FIG. 2 is a partial cross-sectional view taken along the line 2—2 of FIG. 4 and shows the cylinder head assembly and upper portion of the cylinder block.
Figure 3:
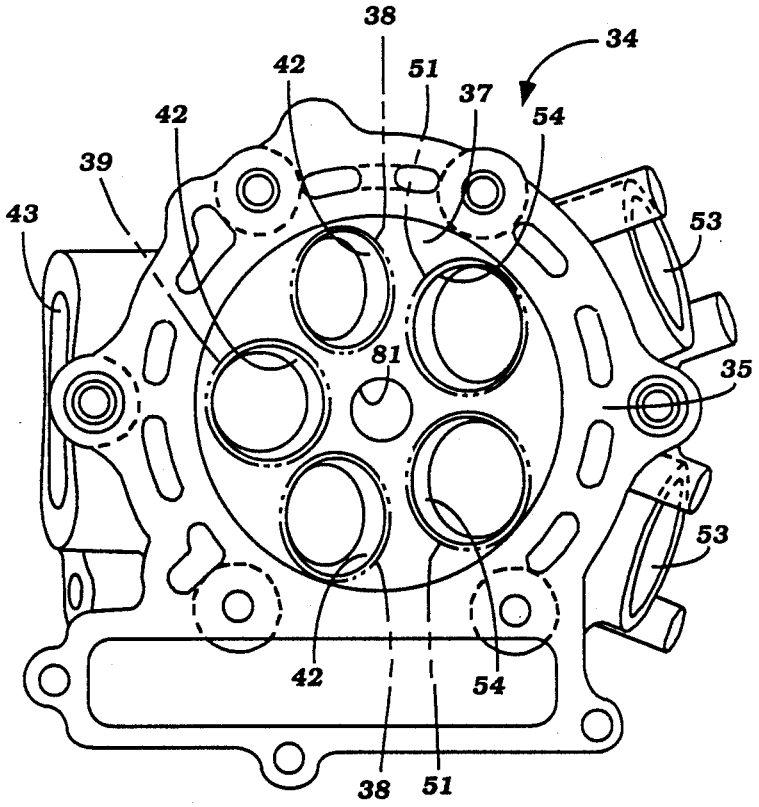
FIG. 3 is a bottom plan view of the cylinder head showing the combustion chamber configuration.
Figure 4:
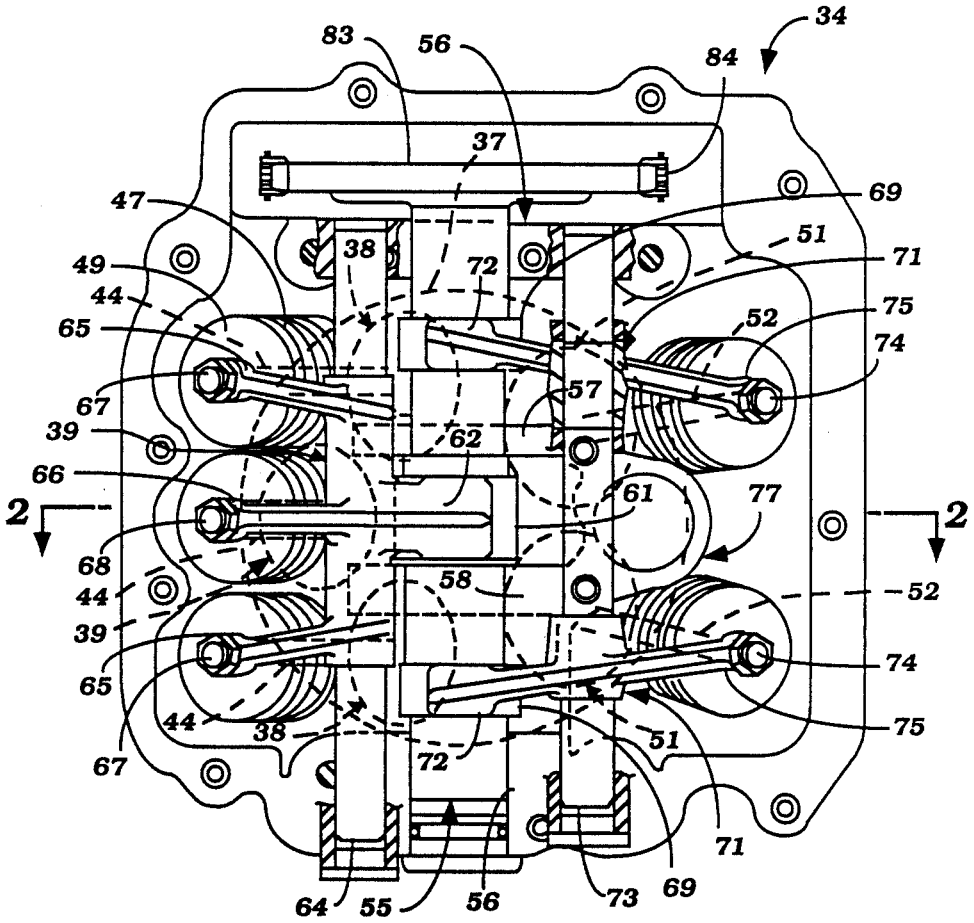
FIG. 4 is a top plan view of the cylinder head assembly with the cam cover and bearing cap assembly removed.

An internal combustion engine, indicated generally by the reference numeral 18 and shown in more details in FIGS. 2 through 4, is supported within the frame assembly 12 by means including an engine mount 19 that is affixed to a gusset plate 21 which is affixed to or forms a part of the frame assembly 12. The engine 18 is further supported in a suitable manner from a down tube 22 of the frame 12.

A fuel tank 23 is supported by the frame 12 above the engine 18 and supplies fuel to the engine in a known manner and specifically to carburetors 24 thereof. An air cleaner 25 supplies filtered air to the carburetors 24.

A seat 26 is supported on the rear of the frame assembly 12 behind the fuel tank 23 so as to accommodate a rider.

The engine 18, as is common with motorcycle practice, includes an integral crankcase, change speed transmission assembly 27 that drives the rear wheel 16 through a chain 28 in a known manner.

The engine 18 or at least portions of it are water cooled and for this purpose there is mounted a radiator 30 on the frame assembly 12 forwardly of the down tube 22. The construction of the motorcycle and its drive arrangement as thus far described may be considered to be conventional and, for that reason, further description of the motorcycle per se is not believed to be necessary to understand the construction and operation of the invention.

Referring now in detail to FIGS. 2 through 4, the construction of the engine 18 will be described in detail. Since the invention relates primarily to the valve actuating mechanism and particularly the camshaft support the valve actuating mechanism, only the top portion of the engine assembly has been depicted and will be described in conjunction with a single cylinder of the engine. In the illustrated embodiment, the engine is of the single cylinder type but it is to be understood that the invention can be practiced in combination with multiple cylinder engines and the adoption of the invention to such engines is believed to be well within the scope of those skilled in the art in view of the following description.

The engine 18 is comprised of a cylinder block assembly 29 that defines one or more cylinder bores 31 by means of pressed in or otherwise inserted liners 32. A piston 33 is supported for recpirocation within the cylinder bore 31 and is connected by means of a connecting rod (not shown) to a crankshaft for driving it in a known manner.

A cylinder head assembly, indicated generally by the reference numeral 34, is affixed to the cylinder block 29 in a known manner and has a downwardly facing sealing surface 35 that is adapted to cooperate with a gasket (not shown) interposed between this surface and a corresponding upper surface of the cylinder block 29 for sealing purposes. Centrally of the sealing surface 35, the cylinder block is provided with a combustion chamber area 36 that is defined by a recess 37 of the cylinder head 34, the head of the piston 33 and cylinder bore 31. The volume of the chamber 36 varies, of course, with the reciprocation of the piston 33 and is shown in FIG. 2 at its top dead center position.

In order to permit an intake charge to be delivered to the combustion chamber 36, there is provided a multiple intake valve assembly which lies generally on one side of a plane containing the axis of the cylinder bore 31 and which extends perpendicularly to the plane of FIG. 2. This intake valve assembly includes a pair of intake valves 38 which are supported for reciprocation about parallel axes that are disposed at an acute angle to the aforenoted plane.

There is provided a further intake valve 39 that is supported by the cylinder head assembly 34 for reciprocation about an acute angle to the aforenoted plane but which angle is different than the angle of the intake valves 38. The disposition of the intake valves 38 and 39 is as set forth in U.S. Letters Pat. No. 4,660,529, entitled "Four Cycle Engine", issued Apr. 28, 1987 and assigned to the assignee of this application. The disclosure of that application for the particular valve orientation and the advantages of it is incorporated herein by reference.

Each of the intake valves 38 and 39 is formed with a head portion 41 that cooperates with a respective valve seat 42 that is pressed into the cylinder head assembly 34 in a known manner. These valve seats are formed at the termination of an intake port 43 that extends through one side of the cylinder head assembly 34 from a single inlet as best shown in FIG. 3 and which terminates at the individual valve seats 42.

Each of the valves 38 and 39 further has a stem portion 44 that is supported for reciprocation within a respective guide 45 formed in a portion 46 of the cylinder head 34.

The valves 38 and 39 are urged toward their closed positions by means of coil compression spring assemblies 47 that bear at their lower ends against a bearing plate 48 engaged with the cylinder head 34 and at their upper ends with a spring retainer 49 that is held to the stem 44 of the respective valve by a keeper assembly of a known type.

On the opposite side of the aforenoted plane, there are supported in the cylinder head assembly 34 a pair of exhaust valves 51 which have stem portions 52 that are reciprocally supported in the cylinder head assembly 34 by valve guides of the type aforedescribed. The valve stems 52 reciprocate about parallel axes which are disposed at an acute angle to the aforenoted plane and which acute angle is less than the acute angle of the pair of intake valves 38 and greater than the acute angle of the intake anble 39. These exhaust valves 51 control the flow of exhaust gases from the combustion chamber to respective exhaust ports 53 formed in the side of the cylinder head 34 opposite the intake passage 43. The valves 51 cooperate with valve seats 54 in a known manner so as to control this flow.

All of the intake valves 38 and 39 and both of the exhaust valves 51 are operated by means of a single overhead camshaft 55. The camshaft 55 is journaled, in a manner to be described, for rotation about a camshaft axis that extends parallel to the aforenoted plane and which may be offset slightly from one side thereof toward the intake valves 38 and 39. However, the axes of reciprocation of the intake valves 38 and 39 all lie on one side of a plane containing the axis of rotation of the camshaft 55 while the axes of reciprocation of the exhaust valves 51 lies on the other side of this plane.

The camshaft 55, since it operates all of the valves 38, 39 and 51, must be very rigidly supported so as to resist any bending forces on it. To that end, the camshaft 55 is provided with spaced bearing portions adjacent the sprocket 53 and its opposite end which are journaled within bearing surfaces 56 formed by the cylinder head 34. In addition, there are provided spaced bearing portions on the camshaft inwardly of its ends that are journaled on bearing surfaces 57 and 58 of the cylinder head assembly 34. The bearing surfaces 56, 57 and 58 of the cylinder head cooperate with corresponding bearing surfaces formed by a combined bearing cap and cam cover assembly, indicated generally by the reference numeral 59 and which is affixed to the cylinder head 34 in a known manner.

The intake valves 38 and 39 are all operated by a single intake lobe 61 of the cam shaft 52, which lobe 61 is disposed immediately adjacent and between the bearing surfaces of the camshaft which cooperate with the cylinder head bearing surfaces 57 and 58 and the corresponding bearing portions of the cam cover, bearing cap 59. As a result, the construction is extremely rigid.

The cam lobe 61 cooperates with a follower portion 62 of a rocker arm 63 that is journaled in the cam cover, bearing cap 59 on a rocker arm shaft 64. The rocker arm shaft 64 is journaled in a suitable manner in the cover 59. The rocker arm 63 has three extending arm portions consisting of a pair of outer portions 65 and a central portion 66. The portions 65 carry adjusting screws 67 that cooperate with the tips of the pair of intake valves 38 so as to operate these valves. In a like manner, the arm portion 66 carries an adjusting screw 68 that cooperates with the tip of the remaining intake valve 39 so as to operate it. As a result, all of the intake valves are operated by a single rocker arm, the arm 63 and a relatively compact yet effective way of operating these multiple valves from a single cam lobe is provided.

The camshaft 55 is also provided with a pair of exhaust lobes 69 which lobes are each disposed between a respective one of the bearing surfaces on the camshaft that cooperate with the cylinder head bearing surfaces 57 and 58 and the portions of the camshaft which cooperate with the cylinder head bearing surfaces 56. A pair of exhaust rocker arms, indicated generally by the reference numerals 71 each have follower portions 72 that cooperate with a respective of the exhaust cam lobes 69 for pivoting the rocker arms 71 about a rocker arm shaft 73 which, like the rocker arm shaft 64, is carried by the cam cover and bearing cap 59. Adjusting screws 74 carried at the outer end 75 of the rocker arms 71 contact the tips of the exhaust valve stems 52 for operating the exhaust valves in a known manner.

The engine is also provided with a spark plug 76 for firing the charge in the combustion chamber 37. The spark plug 76 is received within a spark plug receiving recess 77 formed by aligned bores 78 and 79 formed in the cylinder head 34 and cam cover 59, respectively. A tapped hole 81 formed at the bottom of the cylinder head bore 78 receives the threads of the spark plug so that its gap will be positioned generally centrally of the combustion chamber 37.

The cylinder head 34 is also provided with a cooling jacket 82 through which coolant is circulated from a cooling jacket 82 of the cylinder block 29 in a manner described in my copending application entitled "Cylinder Head Cooling For Multiple Valve Engine", Ser. No. 357,473 , filed May 26, 1989, and assigned to the assignee of this application.

The camshaft 55 carries a sprocket 83 at one end which is driven at one-half crankshaft speed by a chain 84.

Figure 5:
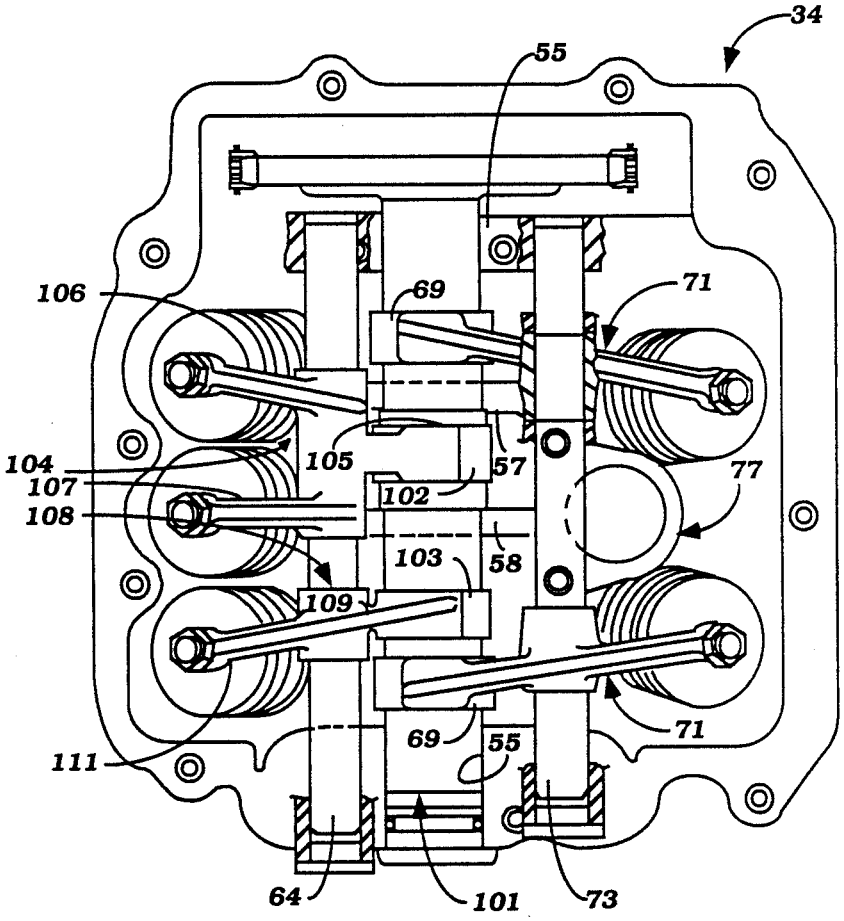
FIG. 5 is a top plan view of the cylinder head assembly of an internal combustion engine, with the cam cover and bearing cap removed, in part similar to FIG. 4, and shows another embodiment of the invention.

In the embodiment of the invention as thus far described, the camshaft 55 was provided with one intake lobe 61 and two exhaust lobes 69 which operated a single rocker arm for operating all of the intake valves 38 and 39 and a pair of rocker arms 71 for operating the exhaust valves 51. It is to be understood that multiple rocker arms can also be employed for operating the intake valves and such an arrangement is shown in FIG. 5. Except for the use of multiple rocker arms and the cam lobe arrangement for operating them, this embodiment is the same as the previously described embodiment and, for that reason, components which are the same as those of the previously described embodiment have been identified by the same reference numerals and will be described again in detail only insofar as is necessary to understand the construction and operation of this embodiment.

Referring now specifically to FIG. 5, the camshaft in this embodiment is identified generally by the reference numeral 101 and has exhaust cam lobes 69 that cooperate with exhaust rocker arms 71 for operating the exhaust valves in the previously described manner. In addition, the camshaft 101 is provided with a first intake lobe 102 that is disposed between the camshaft bearing areas 57 and 58 and a second intake lobe 103 that is disposed between the bearing area 58 and the exhaust cam lobe 69 adjacent the cylinder head bearing area 55. A first rocker arm assembly, indicated generally by the reference numeral 104, has a follower portion 105 that is engaged with the intake cam lobe 102. This rocker arm 104 has a pair of arm portions 106 and 107 that cooperate with one of the pair of intake valves 38 and the center intake valve 39, respectively. The rocker arm assembly 107 is pivotally supported on the rocker arm shaft 64 as aforenoted.

A second rocker arm assembly 108 is also pivotally supported on the rocker arm shaft 64 and has a follower portion 109 that is engaged with the intake lobe 103 of the camshaft 101. The rocker arm 108 has an arm portion 111 that cooperates with the remaining intake valve 38 of this pair. Obviously, the arrangement could be reversed so that the rocker arm 108 also operates the center intake valve 39 while the rocker arm 104 operates only one intake valve.

It should be readily apparent from the foregoing description that the embodiments of the invention provide a very effective and robust arrangement for operating multiple valves from a single camshaft of an internal combustion engine without any likelihood of bending or deflection of the camshaft. Although two embodiments of the invention have been illustrated and described, various changes and modifications may be made without departing from the spirit and scope of the invention, as defined by the appended claims.

I claim:

1. In a camshaft arrangement for a multiple valve internal combustion engine comprising a cylinder head adapted to form in part a combustion chamber, a camshaft journaled for rotation relative to said cylinder head about a camshaft axis, a first plurality of valves supported for reciprocation on one side of said camshaft axis, a second plurality of valves supported for reciprocation on the other side of said camshaft axis, valve actuating means for operating all of said valves from said camshaft, said valve actuating means including at least one cam lobe formed on said camshaft, pivotally supported rocker arm means having a follower portion engaged with said one cam lobe for pivoting said rocker arm means, and bearing means for journaling said camshaft for rotation about bearing surfaces disposed on opposite sides of said one cam lobe and adjacent thereto.

2. In a camshaft arrangement as set forth in claim 1 wherein the camshaft is further journaled by means of spaced and bearing means disposed at opposite ends thereof and on opposite sides of the one cam lobe.

3. In a camshaft arrangement as set forth in claim 2 further including second and third cam lobes each disposed between a respective one of the first mentioned bearing means and the end bearing means for operating further rocker arm means.

4. In a camshaft arrangement as set forth in claim 3 wherein a further rocker arm means operate the respective ones of the second plurality of valves.

5. In a camshaft arrangement as set forth in claim 4 wherein all of the first plurality of valves are operated by the first rocker arm means.

6. In a camshaft arrangement as set forth in claim 5 wherein the first rocker arm means comprises a single rocker arm having one follower engaged with the one cam lobe and arm portions engaged with each of the first plurality of valves.

7. In a camshaft arrangement as set forth in claim 5 wherein the first rocker arm means comprises a first rocker arm engaged with the first cam lobe and a second rocker arm engaged with a further cam lobe disposed adjacent one of the second and third cam lobes and on the other side of the first bearing means for journaling the camshaft.

* * * * *